US009222320B2

(12) United States Patent
Varpe

(10) Patent No.: US 9,222,320 B2
(45) Date of Patent: Dec. 29, 2015

(54) SUBSEA PRESSURE CONTROL SYSTEM

(75) Inventor: Fredrik Varpe, Stavanger (NO)

(73) Assignee: Halliburton Energy Services, Inc., Houston, TX (US)

( * ) Notice: Subject to any disclaimer, the term of this patent is extended or adjusted under 35 U.S.C. 154(b) by 42 days.

(21) Appl. No.: 13/330,059

(22) Filed: Dec. 19, 2011

(65) Prior Publication Data

US 2012/0168171 A1 Jul. 5, 2012

(51) Int. Cl.
*E21B 34/04* (2006.01)
*E21B 21/10* (2006.01)
*E21B 41/00* (2006.01)

(52) U.S. Cl.
CPC ..... *E21B 21/106* (2013.01); *E21B 34/04* (2013.01); *E21B 41/0007* (2013.01)

(58) Field of Classification Search
CPC .... E21B 21/106; E21B 34/04; E21B 41/0007
USPC ..... 166/344, 358, 359, 360, 367, 368; 175/5, 8
See application file for complete search history.

(56) References Cited

U.S. PATENT DOCUMENTS

| | | | | |
|---|---|---|---|---|
| 3,387,851 | A | 6/1968 | Cugini | |
| 3,815,673 | A | 6/1974 | Bruce et al. | |
| 4,091,881 | A * | 5/1978 | Maus | 175/7 |
| 4,234,043 | A | 11/1980 | Roberts | |
| 4,291,772 | A | 9/1981 | Beynet | |
| 4,436,157 | A | 3/1984 | Brooks | |
| 4,474,254 | A | 10/1984 | Etter et al. | |
| 4,502,534 | A | 3/1985 | Roche et al. | |
| 4,626,135 | A * | 12/1986 | Roche | 405/224.2 |
| 4,635,735 | A | 1/1987 | Crownover | |
| 4,682,913 | A | 7/1987 | Shatto et al. | |
| 4,685,521 | A | 8/1987 | Raulins | |
| 4,832,126 | A | 5/1989 | Roche | |
| 4,848,473 | A * | 7/1989 | Lochte | 166/344 |
| 4,880,060 | A * | 11/1989 | Schwendemann et al. | 166/336 |
| 4,899,832 | A | 2/1990 | Bierscheid, Jr. | |
| 5,010,956 | A * | 4/1991 | Bednar | 166/344 |

(Continued)

FOREIGN PATENT DOCUMENTS

| | | | |
|---|---|---|---|
| WO | 0184040 | A1 | 11/2001 |
| WO | 2004085788 | A2 | 10/2004 |

(Continued)

OTHER PUBLICATIONS

International Search Report with Written Opinion issued Nov. 21, 2011 for PCT Patent Application No. PCT/US11/036616, 13 pages.

(Continued)

*Primary Examiner* — James G Sayre
(74) *Attorney, Agent, or Firm* — Chamberlain Hrdlicka

(57) ABSTRACT

A subsea pressure control system can include at least one subsea choke which variably restricts flow of drilling fluid from a well annulus to a surface location, the choke being positioned at a subsea location, and a subsea process control system which automatically operates the subsea choke, whereby a desired pressure is maintained in the well annulus. Another subsea pressure control system can include at least one subsea choke which variably restricts flow of drilling fluid from a well annulus to a surface location, the choke being positioned at a subsea location, and a subsea pump which pumps the drilling fluid from the subsea location to the surface location.

24 Claims, 6 Drawing Sheets

(56) References Cited

U.S. PATENT DOCUMENTS

| | | | | |
|---|---|---|---|---|
| 5,771,974 | A | 6/1998 | Stewart et al. | |
| 6,230,824 | B1 | 5/2001 | Peterman et al. | |
| 6,854,532 | B2 | 2/2005 | Fincher et al. | |
| 6,926,101 | B2 | 8/2005 | Deboer | |
| 7,159,669 | B2 | 1/2007 | Bourgoyne et al. | |
| 7,165,610 | B2 | 1/2007 | Hopper | |
| 7,207,399 | B2 | 4/2007 | Duhe et al. | |
| 7,258,171 | B2 | 8/2007 | Bourgoyne et al. | |
| 7,264,058 | B2 | 9/2007 | Fossli | |
| 7,270,185 | B2 | 9/2007 | Fontana et al. | |
| 7,296,640 | B2 | 11/2007 | Tettleton | |
| 7,367,410 | B2 | 5/2008 | Sangesland | |
| 7,487,837 | B2 | 2/2009 | Bailey et al. | |
| 7,497,266 | B2 | 3/2009 | Fossli | |
| 7,513,310 | B2 | 4/2009 | Fossli | |
| 7,658,228 | B2 | 2/2010 | Moksvold | |
| 7,926,593 | B2 | 4/2011 | Bailey et al. | |
| 7,997,345 | B2 | 8/2011 | Hannegan | |
| 8,033,335 | B2 | 10/2011 | Orbell et al. | |
| 8,322,432 | B2 | 12/2012 | Bailey et al. | |
| 8,640,778 | B2 * | 2/2014 | Fossli | 166/367 |
| 2001/0047885 | A1 | 12/2001 | Calder | |
| 2001/0050185 | A1 * | 12/2001 | Calder et al. | 175/5 |
| 2002/0011338 | A1 | 1/2002 | Maurer et al. | |
| 2003/0066650 | A1 * | 4/2003 | Fontana et al. | 166/358 |
| 2003/0066686 | A1 | 4/2003 | Conn | |
| 2003/0070840 | A1 * | 4/2003 | Boer | 175/5 |
| 2003/0106712 | A1 | 6/2003 | Bourgoyne et al. | |
| 2003/0127230 | A1 * | 7/2003 | von Eberstein et al. | 166/337 |
| 2003/0168258 | A1 | 9/2003 | Koederitz | |
| 2004/0065440 | A1 | 4/2004 | Farabee et al. | |
| 2004/0124008 | A1 * | 7/2004 | Fincher et al. | 175/5 |
| 2004/0244993 | A1 | 12/2004 | Crawford et al. | |
| 2005/0061499 | A1 | 3/2005 | Hopper | |
| 2005/0284659 | A1 | 12/2005 | Hall et al. | |
| 2006/0169491 | A1 | 8/2006 | Fossli | |
| 2008/0060846 | A1 | 3/2008 | Belcher et al. | |
| 2008/0105434 | A1 | 5/2008 | Orbell et al. | |
| 2008/0210471 | A1 | 9/2008 | Bailey et al. | |
| 2008/0251257 | A1 | 10/2008 | Leuchtenberg | |
| 2009/0101351 | A1 | 4/2009 | Hannegan | |
| 2009/0101411 | A1 | 4/2009 | Hannegan et al. | |
| 2009/0139724 | A1 | 6/2009 | Gray et al. | |
| 2009/0145660 | A1 | 6/2009 | Johnson et al. | |
| 2009/0236144 | A1 | 9/2009 | Todd et al. | |
| 2010/0018715 | A1 | 1/2010 | Orbell et al. | |
| 2010/0288507 | A1 | 11/2010 | Duhe et al. | |
| 2011/0024189 | A1 | 2/2011 | Saeed et al. | |
| 2011/0114389 | A1 | 5/2011 | Mathena | |
| 2011/0139464 | A1 | 6/2011 | Henderson et al. | |
| 2011/0139509 | A1 | 6/2011 | Pool et al. | |
| 2012/0292108 | A1 | 11/2012 | Lovorn et al. | |
| 2012/0292109 | A1 | 11/2012 | Lovorn et al. | |
| 2013/0062122 | A1 | 3/2013 | Lovorn et al. | |

FOREIGN PATENT DOCUMENTS

| | | | |
|---|---|---|---|
| WO | 2005076803 | A2 | 8/2005 |
| WO | 2006088379 | A1 | 8/2006 |
| WO | 2007008085 | A1 | 1/2007 |
| WO | 2007030017 | A1 | 3/2007 |
| WO | 2008070665 | A1 | 6/2008 |
| WO | 2008133523 | A1 | 11/2008 |
| WO | 2008134266 | A1 | 11/2008 |
| WO | 2008151128 | A2 | 12/2008 |
| WO | 2008156376 | A1 | 12/2008 |
| WO | 2009017418 | A1 | 2/2009 |
| WO | 2009018448 | A2 | 2/2009 |
| WO | 2009123476 | A1 | 10/2009 |
| WO | 2010071656 | A1 | 6/2010 |
| WO | 2011043764 | A1 | 4/2011 |
| WO | 2012091706 | A1 | 7/2012 |

OTHER PUBLICATIONS

CN Office Action issued Feb. 22, 2012 for CN Patent Application No. 20078004900409.0, 7 pages.
Office Action issued Mar. 14, 2012 for U.S. Appl. No. 12/299,411, 36 pages.
Office Action issued Jun. 28, 2013 for U.S. Appl. No. 13/422,666, 22 pages.
Office Action issued Jun. 28, 2013 for U.S. Appl. No. 13/406,730, 22 pages.
CN Office Action issued Nov. 13, 2012 for CN Patent Application No. 200780049409.0, 5 pages.
Office Action issued Dec. 31, 2012 for U.S. Appl. No. 13/406,730, 44 pages.
Office Action issued Dec. 31, 2012 for U.S. Appl. No. 13/422,666, 33 pages.
Office Action issued Apr. 5, 2013 for U.S. Appl. No. 13/542,892, 12 pages.
Office Action issued Apr. 17, 2013 for U.S. Appl. No. 13/542,781, 10 pages.
Office Action issued May 31, 2013 for U.S. Appl. No. 13/542,875, 10 pages.
Office Action issued Jun. 28, 2013 for U.S. Appl. No. 13/595,803, 19 pages.
Office Action issued Jul. 5, 2013 for U.S. Appl. No. 13/422,666, 36 pages.
International Search Report and Written Opinion issued Jan. 29, 2013 for PCT Patent Application No. PCT/US2012/052559, 9 pages.
Entry for "skid" from the Schlumberger Oilfield Glossary, accessed Sep. 5, 2013 via www.glossary.iolfield.slb.com, 1 page.
Entry for "incorporate" from The Free Dictionary, accessed Sep. 5, 2013 via www.thefreedictionary.com, 3 pages.
Entry for "integrate" from The Free Dictionary, accessed Sep. 5, 2013 via www.thefreedictionary.com, 3 pages.
Entry for "rheology" from The Free Dictionary, accessed Sep. 5, 2013 via www.thefreedictionary.com, 2 pages.
Office Action issued Nov. 6, 2013 for U.S. Appl. No. 13/595,803, 22 pages.
Office Action issued Dec. 5, 2013 for U.S. Appl. No. 13/542,856, 13 pages.
Office Action issued Oct. 7, 2013 for U.S. Appl. No. 13/542,892, 58 pages.
Office Action issued Oct. 18, 2013 for U.S. Appl. No. 13/542,781, 36 pages.
Office Action issued Oct. 29, 2013 for U.S. Appl. No. 13/542,875, 53 pages.
Office Action issued Feb. 3, 2014 for U.S. Appl. No. 12/299,411, 63 pages.
Office Action issued May 7, 2014 for U.S. Appl. No. 13/542,856, 26 pages.
Office Action issued Dec. 24, 2013 for U.S. Appl. No. 13/542,892, 10 pages.

* cited by examiner

SUBSEA PRESSURE CONTROL SYSTEM

CROSS-REFERENCE TO RELATED APPLICATION

This application claims the benefit under 35 USC §119 of the filing date of International Application Serial No. PCT/US10/62394, filed 29 Dec. 2010. The entire disclosure of this prior application is incorporated herein by this reference.

BACKGROUND

The present disclosure relates generally to equipment utilized and operations performed in conjunction with drilling a subterranean well and, in an example described herein, more particularly provides a subsea pressure control system.

In the past, wellbore pressure control has been achieved, for example, by controlling drilling fluid rheology, controlling pressure applied by pumps at a surface location, and variably restricting flow of the drilling fluid from the wellbore at the surface location. These surface activities generally require some modification of surface equipment to accommodate the wellbore pressure control equipment.

However, it would be preferable to avoid extensive modification of surface equipment on facilities used for shallow, deep and ultra-deep water drilling. Furthermore, it would be preferable to control wellbore pressure at a subsea location, in order to maintain a desired wellbore pressure.

DETAILED DESCRIPTION

Figure 1:
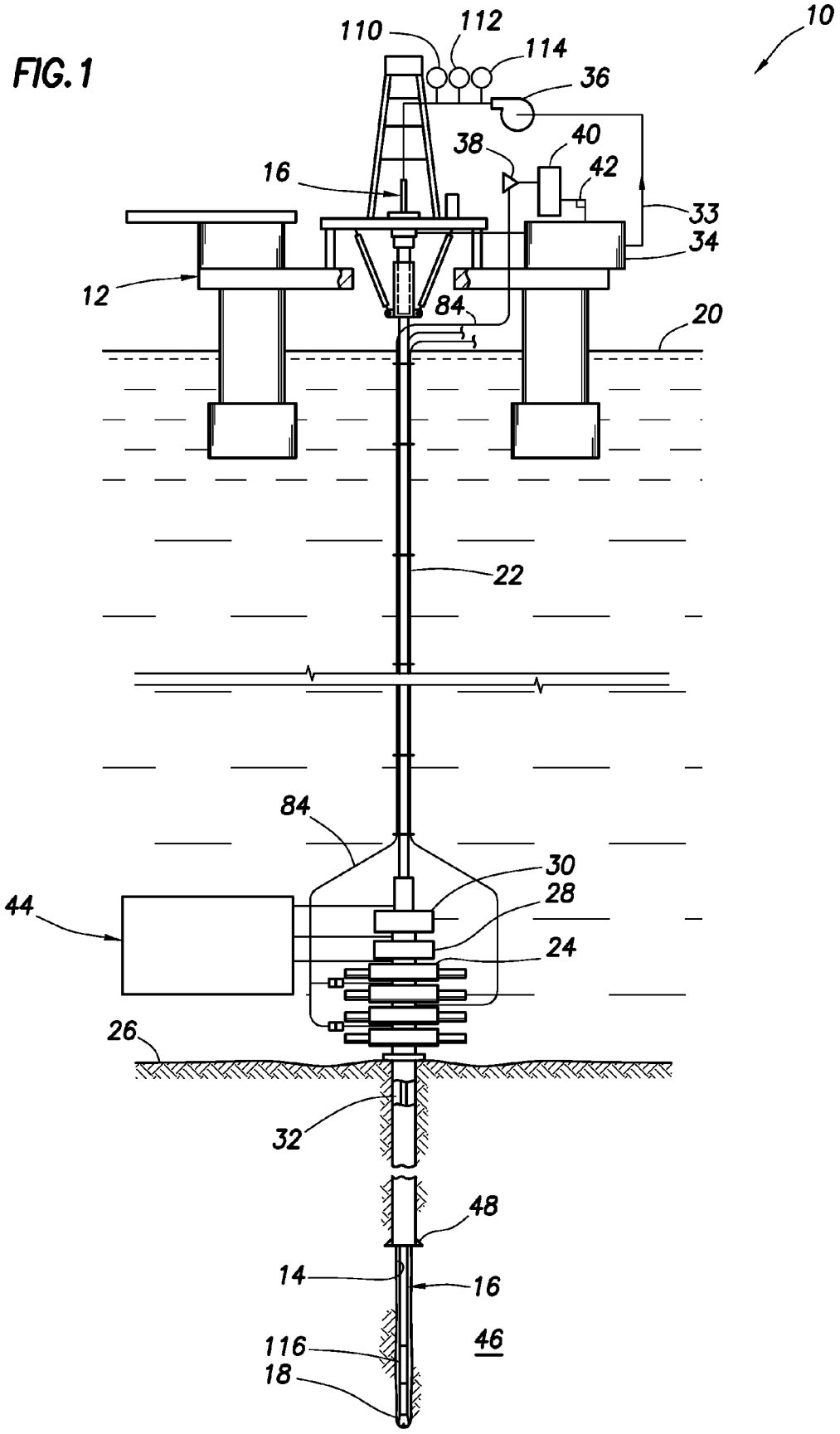
FIG. 1 is a representative partially cross-sectional view of a well system and associated method which can embody principles of the present disclosure.

Representatively illustrated in FIG. 1 is an example of a well system 10 and associated method which can embody principles of the present disclosure. However, it should be clearly understood that the well system 10 and method are merely one example of a variety of systems and methods which are within the scope of this disclosure.

In the well system 10 depicted in FIG. 1, a floating rig 12 is used to drill a wellbore 14. A generally tubular drill string 16 has a drill bit 18 connected at a lower end thereof, and the drill bit is rotated and/or otherwise operated to drill the wellbore 14.

The drill string 16 could be rotated by the rig 12, the drill string could have a Moineau-type fluid motor (not shown) for rotating the drill bit, and/or the wellbore 14 could be drilled by impacts delivered to the drill bit, etc. The drill string 16 could be continuous or segmented, and the drill string could have wires, optical waveguides, fluid conduits or other types of communication paths associated with the drill string for transmission of data signals, command/control signals, power, flow, etc. Thus, it will be appreciated that the drill string 16 depicted in FIG. 1 is merely one example of a variety of different types of drill strings which could be used in the well system 10.

The rig 12 is depicted in FIG. 1 as being a floating rig positioned at a surface location (e.g., at a surface 20 of a deep or ultra-deep body of water). However, if the wellbore 14 were to be drilled from a shallower body of water, the rig 12 could instead be a jack-up type of drilling rig. Therefore, it should be understood that, within the scope of this disclosure, the rig 12 could be any type of drilling rig, platform, etc., capable of drilling the wellbore 14.

In the FIG. 1 example, a marine riser 22 extends between the rig 12 and a blowout preventer stack 24 positioned at a subsea location (e.g., at a mud line or on a seabed 26). The riser 22 serves as a conduit for guiding the drill string 16 between the rig 12 and the blowout preventer stack 24, for flowing fluids between the rig and the wellbore 14, etc. However, in other examples, the wellbore 14 could be drilled without the riser 22.

Interconnected between the riser 22 and the blowout preventer stack 24 are an annular blowout preventer 28 and a subsea annular sealing device 30. The annular blowout preventer 28 is designed to seal off an annulus 32 about the drill string 16 in certain situations (e.g., to prevent inadvertent release of fluids from the well in an emergency, etc.), although a typical annular blowout preventer can seal off the top of the blowout preventer stack 24 even if the drill string is not present in the annular blowout preventer.

The annular sealing device 30 is also designed to seal off the annulus 32 about the drill string 16, but the annular sealing device is designed to do so while the drill string is being used to drill the wellbore 14. If the drill string 16 rotates while drilling the wellbore 14, the annular sealing device 32 is designed to seal about the rotating drill string.

The annular sealing device 32 may be of the type known to those skilled in the art as a rotating blowout preventer, a rotating head, a rotating diverter, a rotating control device (RCD), etc. The annular sealing device 32 may be passive or active, in that one or more seals thereof may be always, or selectively, extended into sealing engagement with the drill string 16. The seal(s) of the annular sealing device 32 may or may not rotate with the drill string 16.

Drilling fluid 33 is contained in a reservoir 34 of the rig 12. A rig pump 36 is used to pump the drilling fluid into the drill string 16 at the surface. The drilling fluid flows through the drill string 16 and into the wellbore 14 (e.g., exiting the drill string at the drill bit 18).

The drilling fluid 33 then flows through the annulus 32 back to the reservoir 34 via a choke manifold 38, a mud buster or "poor boy" degasser 40, a solids separator 42, etc. However, it should be understood that other types and combinations of drilling fluid handling, conditioning and processing equipment may be used within the scope of this disclosure.

In an important feature of the well system 10, a subsea pressure control system 44 is used to control pressure in the wellbore 14. As depicted in FIG. 1, the pressure control system 44 is positioned at the subsea location, where it can exert immediate control of pressure in the well annulus 32 at the subsea location.

In examples described below, the pressure control system 44 can control the pressure in the well annulus 32 whether or not the drilling fluid 33 is being circulated through the drill string 16. In other examples described below, the pressure control system 44 can also control a level of hydrostatic pressure applied to the well annulus 32 at the subsea location.

In different situations, it may be desired for pressure in the wellbore 14 to be less than, greater than or equal to pore pressure in an earth formation 46 penetrated by the wellbore. Typically, it is desired for the wellbore pressure to be less than a fracture pressure of the formation 46.

Persons skilled in the art use terms such as underbalanced drilling, managed pressure drilling, at balance drilling, conventional overbalanced drilling, etc., to describe how wellbore pressure is controlled during the drilling of a wellbore. The pressure control system 44 can be used to control wellbore pressure in any type of drilling operation, and with any desired relationship between wellbore pressure and formation pore and/or fracture pressure.

The pressure control system 44 can be used to control pressure applied to the well annulus 32 at the subsea location by a column of fluid in the riser 22, or in a line external to the riser. In an example described below, a subsea pump is used to adjust a height of the column of fluid, to thereby achieve a desired hydrostatic pressure of the fluid at the subsea location.

The pressure control system 44 can be used to control pressure over time at any location along the wellbore 14, and for any purpose. For example, it may be desired to precisely control pressure at a bottom end of the wellbore 14, or at a particular location relative to the formation 46, or at a pressure sensitive area (such as, at a casing shoe 48), etc. Control over the wellbore pressure may be for purposes of avoiding fractures of the formation 46, avoiding loss of drilling fluid 33, preventing undesired influx of formation fluid into the wellbore 14, preventing damage to the formation, etc.

The pressure control system 44 can be used to control pressure in the wellbore 14 by controlling pressure in the annulus 32 at the subsea location. Such control can be exercised whether or not the drilling fluid 33 is currently being flowed through the drill string 16 into the wellbore 14, and from the wellbore to the rig 12 at the surface location.

Figure 2:
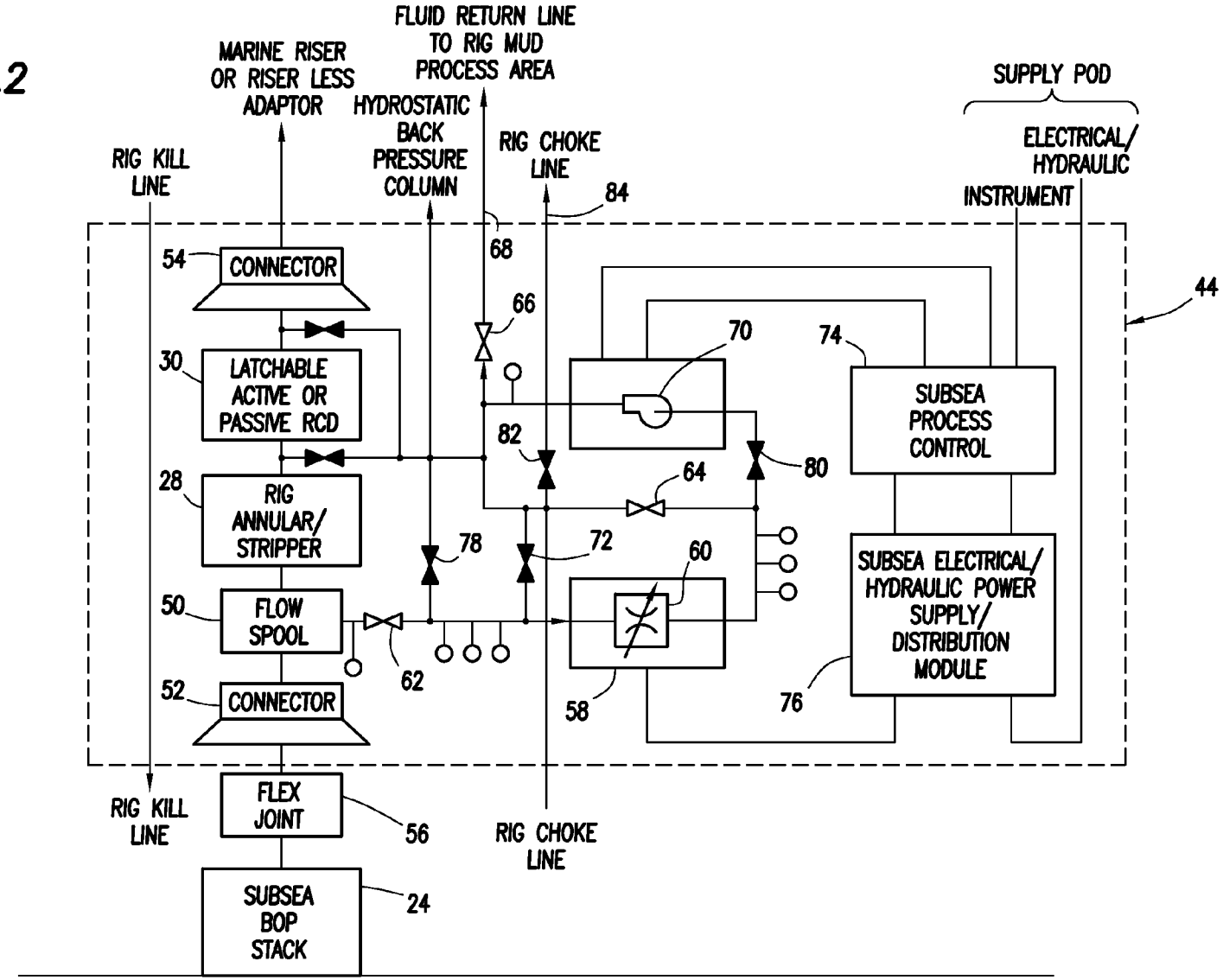
FIG. 2 is a representative block diagram of a subsea pressure control system which may be used in the well system and method of FIG. 1, the subsea pressure control system being depicted in a drill-ahead configuration.

Referring additionally now to FIG. 2, a block diagram of one example of the pressure control system 44 is representatively illustrated. The pressure control system 44 depicted in FIG. 2 can be used in the well system 10 described above, or in other well system configurations.

The pressure control system 44 is illustrated in FIG. 2 as including the annular blowout preventer 28 and annular sealing device 30 described above, but it should be understood that it is not necessary for the pressure control system to include these elements or associated flow spool 50 and connectors 52, 54, since the pressure control system could be connected to other equipment, such as existing equipment, in other examples.

As depicted in FIG. 2, the lower connector 52 connects the flow spool 50 to a flex joint 56 on top of the blowout preventer stack 24. The upper connector 54 connects the annular sealing device 30 to the riser 22, or to a riser-less adaptor if no riser is used.

In the example configuration depicted in FIG. 2, drilling is progressing, with the drilling fluid being flowed through the drill string 16, into the annulus 32 and back to the reservoir 34 at the surface. A choke manifold 58 receives the drilling fluid from the annulus 32 and variably restricts the flow of the drilling fluid, to thereby variably adjust pressure applied to the annulus at the subsea location.

Although only one choke 60 is shown in FIG. 2, the choke manifold 58 preferably includes multiple chokes, with the ability to flow the drilling fluid 33 through one or more of the chokes. In some examples, the pressure control system 44 can detect plugging of a choke (e.g., by monitoring pressure differential across the choke, flow rate through the choke, etc.), can switch flow from one choke to another, can flush a choke to remove solids from a flow passage of the choke, etc.

The choke manifold 58 can be automatically controlled, for example, to automatically maintain a desired pressure applied to the annulus 32 at the subsea location. If pressure in the annulus 32 at the subsea location is less than that desired (e.g., less than that needed to achieve a desired pressure in the wellbore 14), restriction to flow through the choke 60 can be increased, thereby increasing the pressure applied to the annulus. If pressure in the annulus 32 is greater than that desired, restriction to flow through the choke 60 can be decreased, thereby decreasing the pressure applied to the annulus at the subsea location.

The annulus 32 is sealed off by the annular sealing device 30, thereby forcing the drilling fluid to flow out of the flow spool 50, through open valve 62 to the choke manifold 58, and then through open valves 64, 66 and via fluid return line 68 to the rig 12. In this configuration, the pressure control system 44 can be used for underbalanced or managed pressure drilling, etc.

If, however, the drilling fluid 33 is not being circulated through the drill string 16 and annulus 32 (such as, while a connection is being made in the drill string, while actual drilling is stopped, etc.), fluid can still be flowed through the choke manifold 58 to thereby allow for control over the pressure applied to the annulus 32 at the subsea location. This flow through the choke manifold 58 can be provided by a pump 70, as depicted in the configuration of FIG. 3.

The pump 70 can be a variable speed pump, the output of which can be varied using variable frequency drive, variable hydraulic power, etc. Thus, the pressure and flow output by the pump 70 can preferably be adjusted as desired.

Figure 3:
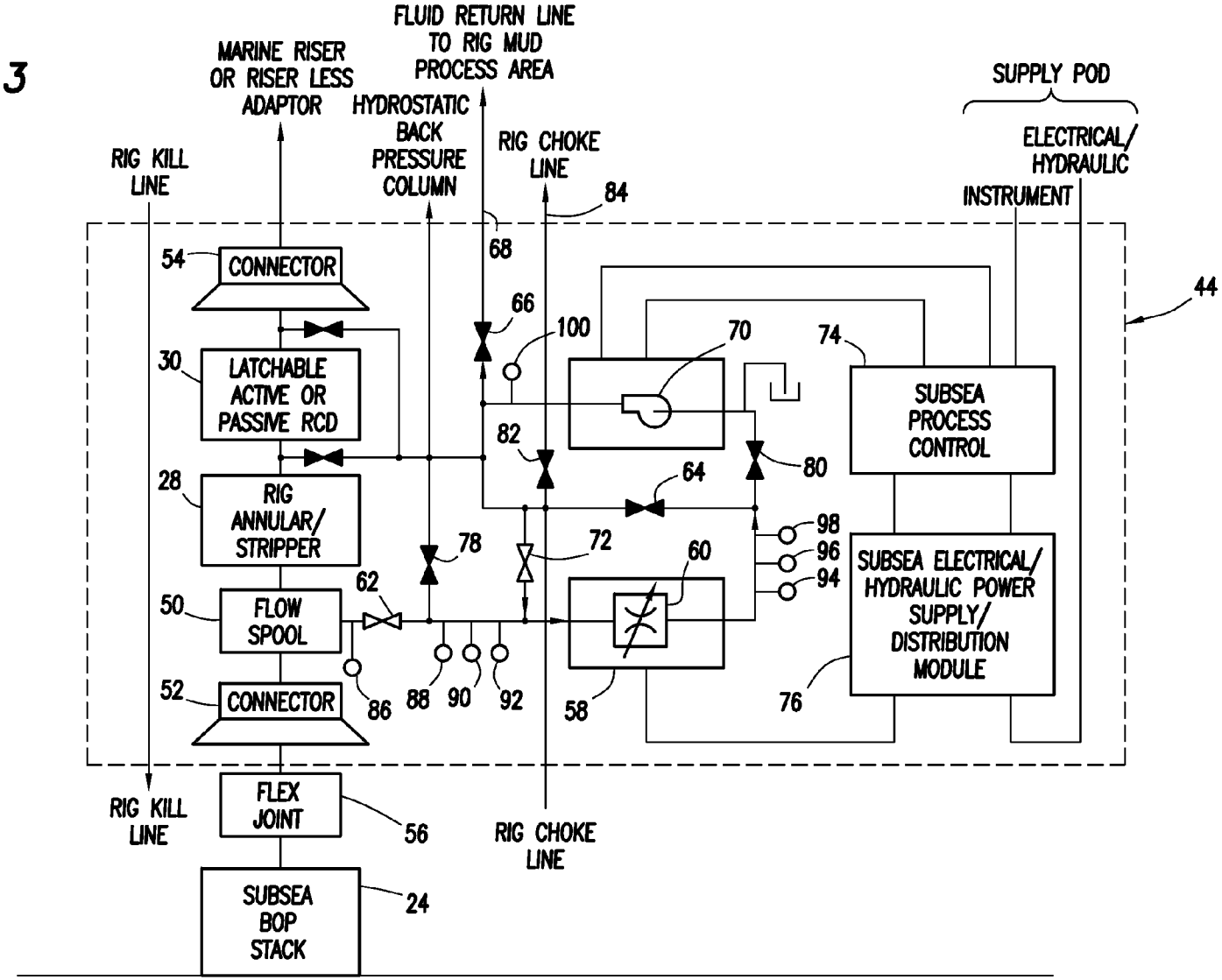
FIG. 3 is a representative block diagram of the subsea pressure control system, depicted in an interrupted circulation configuration.

Note that, in FIG. 3, the formerly open valves 64, 66 are closed, and another valve 72 is open, allowing fluid to be pumped from the pump 70 to an upstream side of the choke manifold 58. The choke 60 variably restricts this flow, to thereby apply a desired pressure to the annulus 32.

Instead of using the pump 70 to flow fluid through the choke 60 while the drilling fluid 33 is not being flowed through the drill string 16 and annulus 32, the valve 62 could be closed to trap a desired pressure in the annulus. For example, when it is desired to make a connection in the drill string 16 (e.g., to add a section of drill pipe to the drill string), the output of the rig pump 36 can be gradually decreased while the valve 62 is gradually closed, thereby trapping the desired pressure in the annulus 32. After the connection is made, the output of the rig pump 36 can be gradually increased while the valve 62 is gradually opened, thereby maintaining the desired pressure in the annulus 32 while circulation through the drill string 16 and annulus is restarted.

The choke 60 and the pump 70 are controlled by means of a subsea process control system 74 included in the pressure control system 44. The process control system 74 could instead be located on the rig 12 or at another surface location (such as, at a remote operations center) in other examples, in which case the process control system could remotely control operation of the choke 60 and pump 70 via wires, lines, fiber optics, telemetry, etc.

A subsea communication system 76 is used to supply electrical, hydraulic and/or optical power and communications for the process control system 74, the choke 60 and the pump 70. Together, the process control system 74 and the communication system 76 are used to operate the choke manifold 58, the pump 70 and at least valves 62, 64, 66, 72, 78, 80, 82.

In the event of a well control problem which cannot be handled adequately by the pressure control system 44 (such as, a large influx of gas into the wellbore 14, etc.), the valve 82 can be opened to allow the drilling fluid 33 to be flowed to the rig choke manifold 38 via a conventional rig choke line 84.

Pressure, flow and temperature sensors 86, 88, 90, 92, 94, 96, 98, 100 are strategically placed in the pressure control system 44 to monitor conditions at various locations relative to the flow control components of the system. Sensor 86 measures pressure in the annulus 32, and sensors 88, 90 and 92 respectively measure pressure, temperature and flow upstream of the choke manifold 58. Respective pressure, temperature and flow sensors 94, 96, 98 measure pressure, temperature and flow downstream of the choke manifold 58, and upstream of the pump 70. Flow sensor 100 measures the output of the pump 70.

Of course, in other examples of the pressure control system 44, other numbers, types, combinations, positions, etc. of sensors can be used to monitor parameters for use in determining what a desired wellbore pressure should be, and whether conditions are appropriate in the pressure control system to achieve and maintain that desired wellbore pressure over time. Control over the wellbore pressure can be exercised in part by controlling the pressure applied to the annulus 32 at the subsea location.

The pressure applied to the annulus 32 at the subsea location is a summation of various factors, among them a hydrostatic pressure of a column of fluid above the subsea location, back pressure due to a restriction to flow of fluid through the choke 60, pressure applied by the pump 70, fluid friction due to flow of the drilling fluid 33 from the subsea location to the surface location, etc. Most of these factors can be controlled by means of the pressure control system 44.

With regard to control over the hydrostatic pressure of the column of fluid above the subsea location, note that this column of fluid could be in the riser 22, in a line positioned external to the riser, etc. The pump 70 can be used to adjust a height of the column of fluid, to thereby adjust the hydrostatic pressure exerted by the column of fluid on the annulus 32 at the subsea location.

Figure 4:
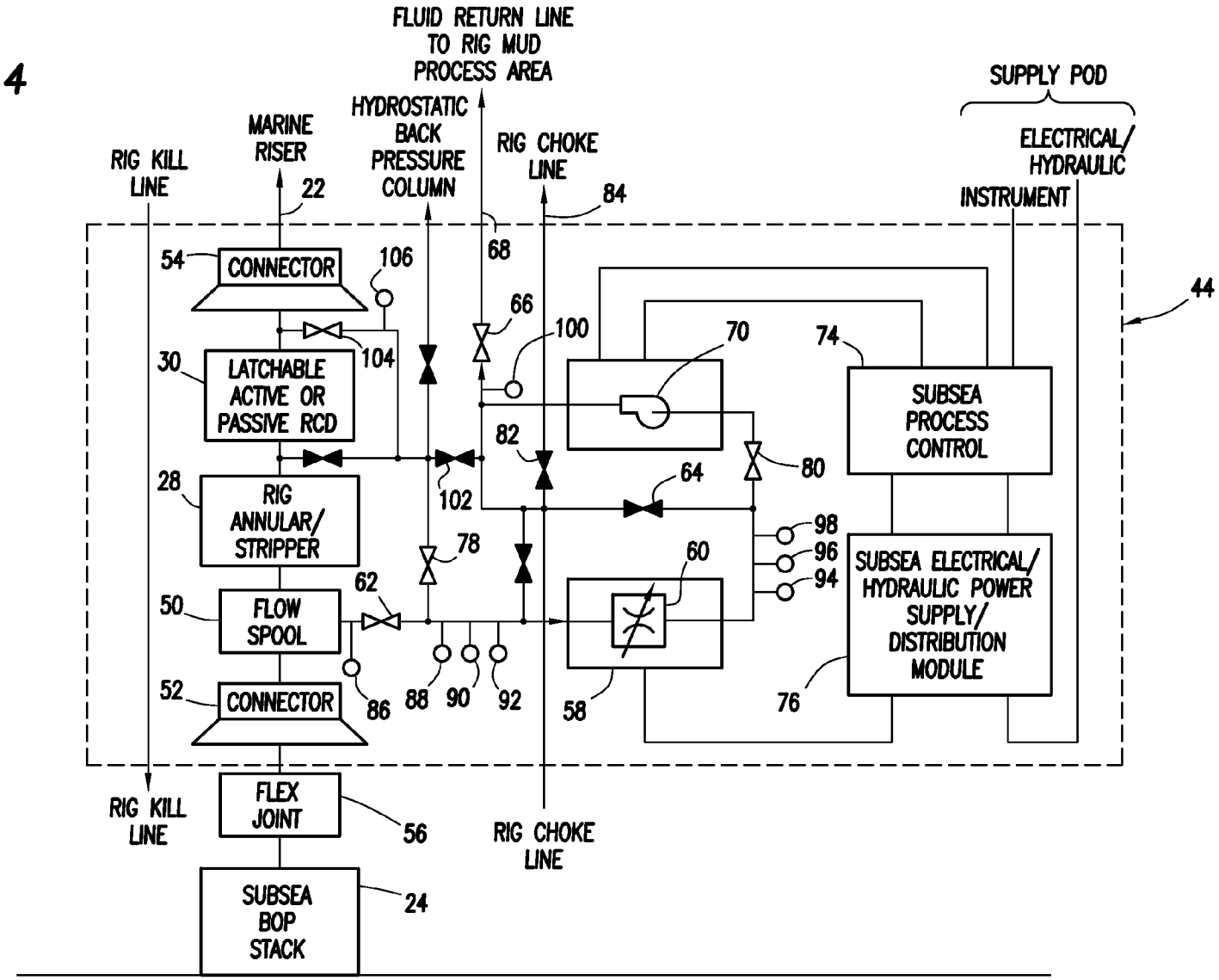
FIG. 4 is a representative block diagram of the subsea pressure control system, depicted in a riser hydrostatic pressure control configuration.

As depicted in FIG. 4, the pump 70 can be operated to adjust a level of fluid in the riser 22. The pump 70 is connected to the fluid in the riser 22 via open valves 102, 104. The pressure at the lower end of the riser 22 is monitored with a pressure sensor 106.

Figure 5:
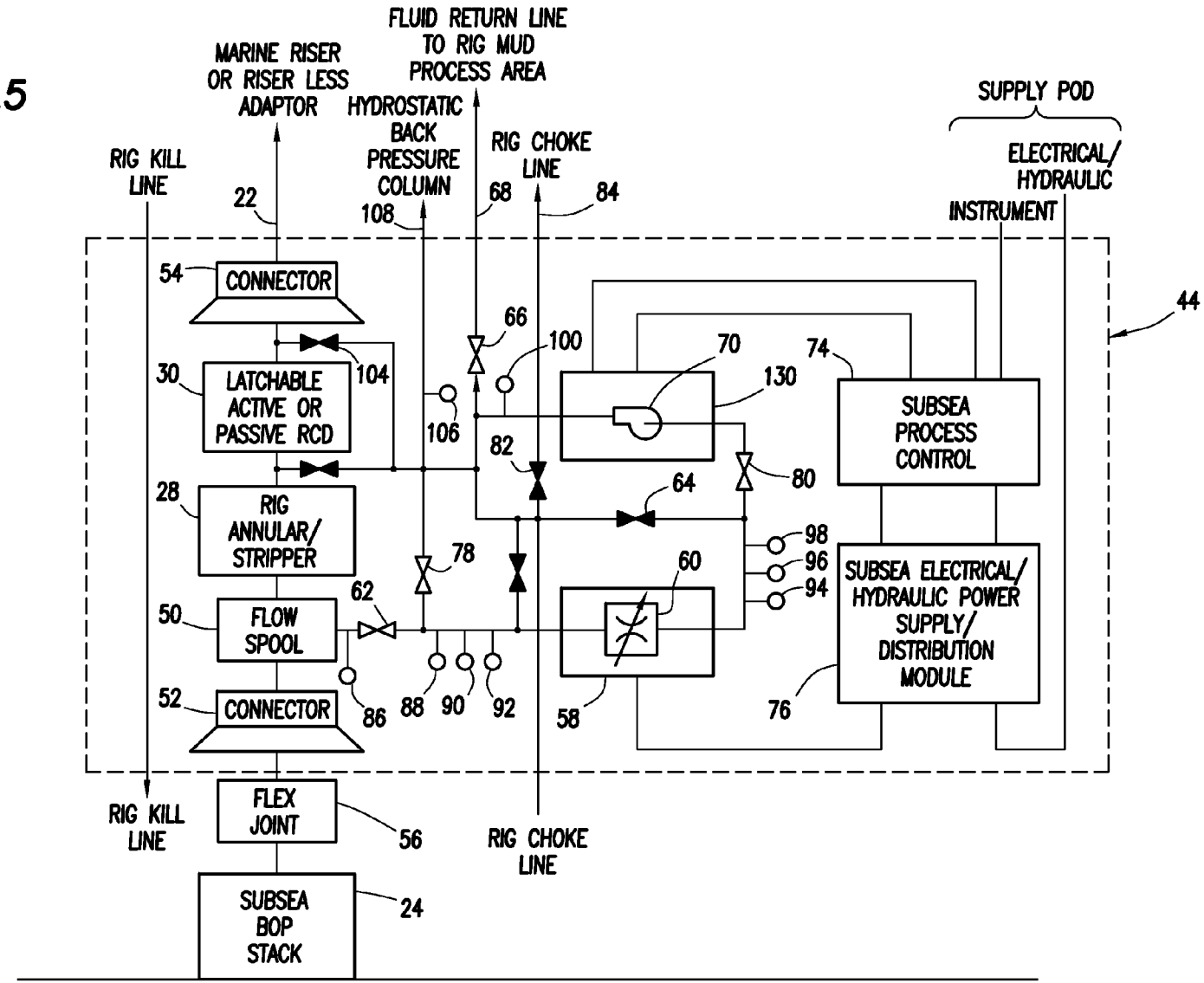
FIG. 5 is a representative block diagram of the subsea pressure control system, depicted in another hydrostatic pressure control configuration.

As depicted in FIG. 5, the pump 70 can be operated to adjust a level of fluid in a flow line 108 external to the riser 22. Alternatively, the line 108 can be used in a riser-less drilling operation. In this configuration, the pressure sensor 106 monitors pressure at the lower end of the line 108.

Figure 6:
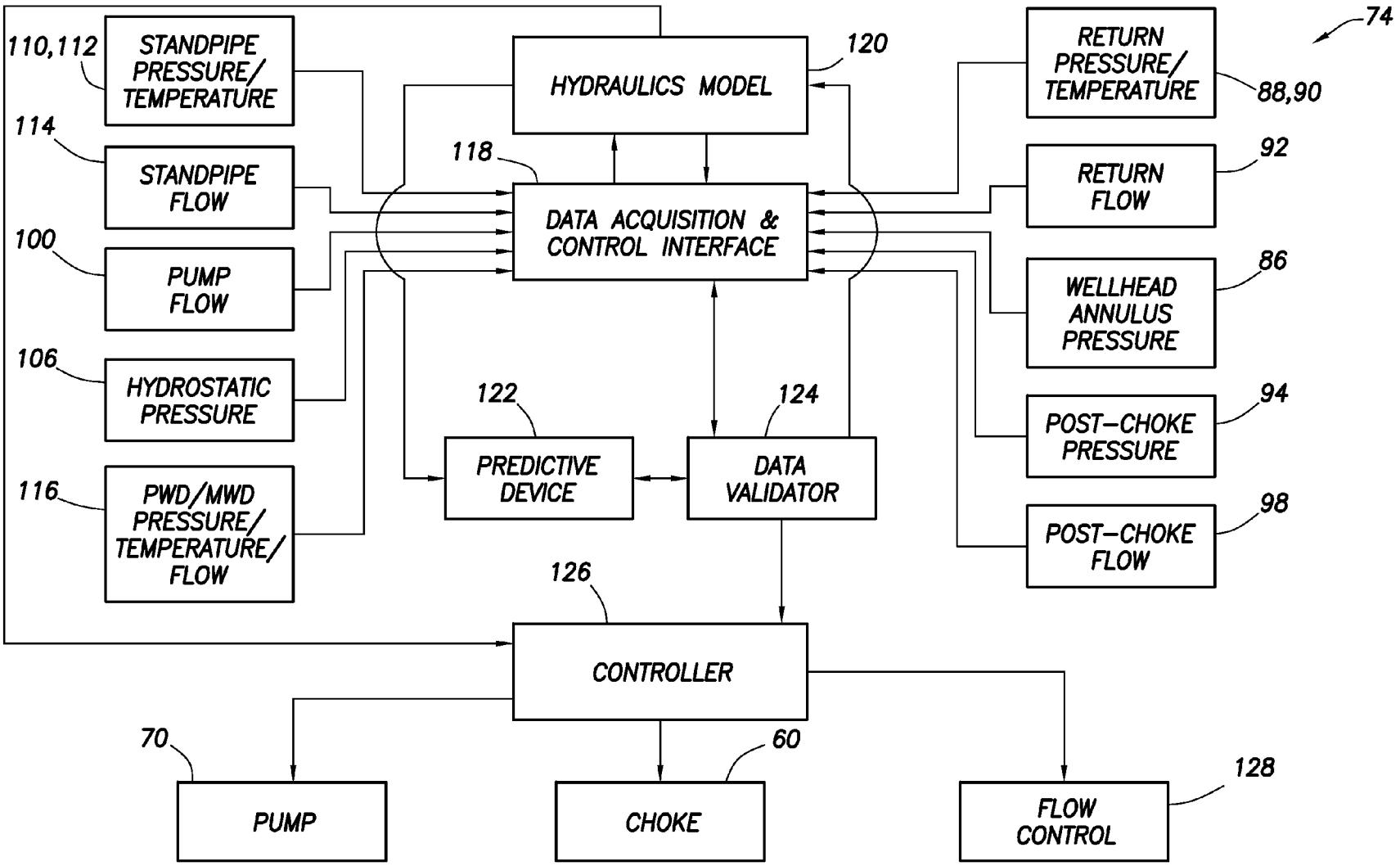
FIG. 6 is a representative block diagram of a subsea process control system which may be used in the subsea pressure control system.

Referring additionally now to FIG. 6, a block diagram of one example of the process control system 74 is representatively illustrated. In other examples, the process control system 74 could include other numbers, types, combinations, etc., of elements, and any of the elements could be positioned at the surface location or at the subsea location, in keeping with the scope of this disclosure.

As depicted in FIG. 6, the process control system 74 includes a data acquisition and control interface 118, a hydraulics model 120, a predictive device 122, a data validator 124 and a controller 126. These elements are preferably similar to those described in international patent application serial no. PCT/US10/56433 filed on 12 Nov. 2010.

The hydraulics model 120 is used to determine a desired pressure in the annulus 32 to achieve a desired pressure in the wellbore 14. The hydraulics model 120 models the wellbore 14, the drill string 16, flow of the fluid through the drill string and annulus 32 (including equivalent circulating density due to such flow), etc.

The data acquisition and control interface 118 receives data from the various sensors 86, 88, 90, 92, 94, 96, 98, 100, 106, 110, 112, 114, 116 and relays this data to the hydraulics model 120 and the data validator 124. In addition, the interface 118 relays the desired annulus pressure from the hydraulics model 120 to the data validator 124.

The predictive device 122 can be included in this example to determine, based on past data, what sensor data should currently be received and what the desired annulus pressure should be. The predictive device 122 could comprise a neural network, a genetic algorithm, fuzzy logic, etc., or any combination of predictive elements to produce predictions of the sensor data and desired annulus pressure.

The data validator 124 uses these predictions to determine whether any particular sensor data is valid, whether the desired annulus pressure output by the hydraulics model 120 is appropriate, etc. If it is appropriate, the data validator 124 transmits the desired annulus pressure to the controller 126 (such as a programmable logic controller), which controls operation of the choke 60, the pump 70 and the various flow control devices 128 (such as valves 62, 64, 66, 78, 80, 104).

In this manner, the choke 60, pump 70 and flow control devices 128 can be automatically controlled to achieve and maintain the desired pressure in the annulus 32 at the subsea location. Beneficially, this control is exercised at the subsea location in relatively close proximity to the wellbore 14 (and the lower ends of the riser 22 or line 108 if a height of a fluid column in either of these is used to control hydrostatic pressure applied to the annulus 32).

It may now be fully appreciated that the above-described well system 10, pressure control system 44 and process control system 74 provide a number of advancements to the art of controlling pressure in a wellbore during drilling operations. In the described examples, the subsea choke 60 and the subsea pump 70 can be used to control pressure in the annulus 32 at the subsea location, with the choke and the pump being desirably positioned at the subsea location.

The pressure control system 44 can be integrated into virtually any drilling operation without requiring extensive modifications to the rig 12. Instead, the pressure control system 44 is desirably located subsea, in close proximity to the wellbore 14 and access to the annulus 32.

The pressure control system 44 can be used in virtually any water depth (e.g., shallow, deep, ultra-deep water). The same pressure control system 44 can be used for different water depths (i.e., there is no need to change a pressure control system to configure it for different water depths).

The pressure control system 44 as depicted in FIGS. 2-5 is preferably modular, in that the choke manifold 58 the process control system 74, the communication system 76 and a pump module 130 comprising the pump 70 are separate modules which can be connected to each other and configured to achieve certain purposes. The valves 62, 64, 66, 78, 80, 104 could likewise be combined in a flow control module or manifold, if desired. The sensors 86, 88, 90, 92, 94, 96, 98, 100, 106, 110, 112, 114, 116 could be incorporated into various ones of the modules.

In particular, the above disclosure provides to the art a subsea pressure control system 44 which can include at least one subsea choke 60 which variably restricts flow of drilling fluid from a well annulus 32 to a surface location, with the choke 60 being positioned at a subsea location. A subsea process control system 74 can automatically operate the subsea choke 60, whereby a desired pressure is maintained in the well annulus 32.

The subsea process control system 74 can automatically operate the subsea choke 60 in response to measurements made by at least one subsea sensor 86, 88, 90, 92, 94, 96, 98, 100, 106, 110, 112, 114, 116. The subsea sensor 86 can be used to measure pressure in the well annulus 32. The subsea sensors 92, 98 can measure flow rate through the subsea choke 60.

The subsea pressure control system 44 can include a subsea pump 70 which pumps the drilling fluid from the subsea location to the surface location. The subsea pump 70 may pump the drilling fluid to the surface location via a marine riser 22, or via a line 108 external to the marine riser 22.

The drilling fluid may flow from the subsea choke 60 to the subsea pump 70. The subsea pump 70 may also be used to flow the drilling fluid through the subsea choke 60 while the drilling fluid is not flowed through a drill string 16.

The subsea pump 70 may be used to regulate a fluid level in a marine riser 22, or in a line 108 external to the riser, whereby a desired hydrostatic pressure is applied to the well annulus 32.

The subsea pressure control system 44 may include a subsea annular sealing device 30 which seals off the well annulus 32 while a drill string 16 rotates in the subsea annular sealing device 30. The subsea choke 60 may receive the drilling fluid from the well annulus 32 below the subsea rotating control device 30.

Also described by the above disclosure is a subsea pressure control system 44 which includes at least one subsea choke 60 which variably restricts flow of drilling fluid from a well annulus 32 to a surface location, the choke 60 being positioned at a subsea location, and a subsea pump 70 which pumps the drilling fluid from the subsea location to the surface location.

It is to be understood that the various embodiments of the present disclosure described herein may be utilized in various orientations, such as inclined, inverted, horizontal, vertical, etc., and in various configurations, without departing from the principles of the present disclosure. The embodiments are described merely as examples of useful applications of the principles of the disclosure, which is not limited to any specific details of these embodiments.

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of the present disclosure. Accordingly, the foregoing detailed description is to be clearly understood as being given by way of illustration and example only, the spirit and scope of the present invention being limited solely by the appended claims and their equivalents.

What is claimed is:

1. A subsea pressure control system for use with a subsea well with a well annulus and a marine riser, comprising:

at least one subsea choke configured to variably restrict flow of drilling fluid from the well annulus through a flow passage which branches off of the well annulus below a subsea annular sealing device configured to seal off the well annulus, the subsea choke being positionable at a subsea location;

a process control system configured to automatically operate the at least one subsea choke and a subsea pump to maintain a given pressure in the well annulus; and the subsea pump configured to regulate a fluid level in a line external to the marine riser to apply a given hydrostatic pressure to the well annulus, the subsea pump at the subsea location.

2. The subsea pressure control system of claim 1, wherein the process control system is configured to automatically operate the subsea choke in response to measurements made by at least one subsea sensor.

3. The subsea pressure control system of claim 2, wherein the subsea sensor is configured to measure pressure in the well annulus.

4. The subsea pressure control system of claim 2, wherein the subsea sensor is configured to measure flow rate through the subsea choke.

5. The subsea pressure control system of claim 1, wherein the subsea pump is configured to pump the drilling fluid from the subsea location to the surface location.

6. The subsea pressure control system of claim 5, wherein the subsea pump is configured to pump the drilling fluid to the surface location via a marine riser.

7. The subsea pressure control system of claim 5, wherein the subsea pump is configured to pump the drilling fluid to the surface location via a line external to a marine riser.

8. The subsea pressure control system of claim 5, wherein the drilling fluid flows from the subsea choke to the subsea pump.

9. The subsea pressure control system of claim 5, wherein the subsea pump is configured to flow the drilling fluid through the subsea choke while the drilling fluid is not flowed through a drill string.

10. The subsea pressure control system of claim 1, wherein the subsea pump is configured to flow the drilling fluid through the subsea choke while the drilling fluid is not flowed through a drill string.

11. The subsea pressure control system of claim 1, wherein the subsea annular sealing device is configured to seal off the well annulus while a drill string rotates in the subsea annular sealing device.

12. The subsea pressure control system of claim 11, wherein the subsea choke is configured to receive the drilling fluid from the well annulus below the subsea annular sealing device.

13. A subsea pressure control system for a well with an annulus, comprising:

a drill string through which drilling fluid is flowable from a surface location;

at least one subsea choke configured to variably restrict flow of the drilling fluid from the well annulus through a flow passage which branches off of the well annulus below a subsea annular sealing device configured to seal off the well annulus, the at least one subsea choke being positionable at a subsea location;

a process control system configured to automatically operate the at least one subsea choke and a subsea pump to maintain a given pressure in the well annulus; and a subsea pump configured to pump the drilling fluid from the subsea location to the surface location, wherein the subsea pump is also configured to flow the drilling fluid through the subsea choke while the drilling fluid is not flowed through the drill string and configured to regulate a fluid level in a line external to a marine riser to apply a given hydrostatic pressure to the well annulus, the subsea pump being positionable at the subsea location.

14. The subsea pressure control system of claim 13, wherein the subsea pump is configured to pump the drilling fluid to the surface location via a marine riser.

15. The subsea pressure control system of claim 13, wherein the subsea pump is configured to pump the drilling fluid to the surface location via a line external to a marine riser.

16. The subsea pressure control system of claim 13, wherein the drilling fluid flows from the subsea choke to the subsea pump.

17. The subsea pressure control system of claim 13, wherein the subsea pump is configured to regulate a fluid level in a marine riser to apply a desired hydrostatic pressure to the well annulus.

18. The subsea pressure control system of claim 13, wherein the subsea pump is configured to regulate a fluid level in a line external to a marine riser to apply a desired hydrostatic pressure to the well annulus.

19. The subsea pressure control system of claim 13, wherein the process control system is configured to automatically operate the subsea pump.

20. The subsea pressure control system of claim 19, wherein the process control system is configured to automatically operate the subsea choke in response to measurements made by at least one subsea sensor.

21. The subsea pressure control system of claim 20, wherein the subsea sensor is configured to measure pressure in the well annulus.

22. The subsea pressure control system of claim 20, wherein the subsea sensor is configured to measure flow rate through the subsea choke.

23. The subsea pressure control system of claim 13, wherein the subsea annular sealing device is configured to seal off the well annulus while the drill string rotates in the subsea annular sealing device.

24. The subsea pressure control system of claim 23, wherein the subsea choke is configured to receive the drilling fluid from the well annulus below the subsea annular sealing device.

* * * * *